US008950611B2

(12) United States Patent
Derrien et al.

(10) Patent No.: US 8,950,611 B2
(45) Date of Patent: Feb. 10, 2015

(54) CONTAINER COMPRISING A BOTTOM EQUIPPED WITH A DEFORMABLE MEMBRANE

(75) Inventors: Mikael Derrien, Octeville sur Mer (FR); Didier Burel, Octeville sur Mer (FR); David Andrieux, Octeville sur Mer (FR); Michel Boukobza, Octeville sur Mer (FR)

(73) Assignee: Sidel Participations, Octeville sur Mer (FR)

( * ) Notice: Subject to any disclaimer, the term of this patent is extended or adjusted under 35 U.S.C. 154(b) by 794 days.

(21) Appl. No.: 12/671,349

(22) PCT Filed: Jul. 29, 2008

(86) PCT No.: PCT/FR2008/001131
§ 371 (c)(1),
(2), (4) Date: May 14, 2010

(87) PCT Pub. No.: WO2009/050346
PCT Pub. Date: Apr. 23, 2009

(65) Prior Publication Data

US 2010/0219152 A1 Sep. 2, 2010

(30) Foreign Application Priority Data

Jul. 30, 2007 (FR) ..... 07 05554

(51) Int. Cl.
*B65D 1/02* (2006.01)
*B65D 79/00* (2006.01)

(52) U.S. Cl.
CPC ..... *B65D 1/0276* (2013.01); *B65D 79/005* (2013.01); *B65D 2501/0036* (2013.01)
USPC ..... 215/373; 215/374

(58) Field of Classification Search
USPC ..... 215/373, 374
See application file for complete search history.

(56) References Cited

U.S. PATENT DOCUMENTS

| | | | | |
|---|---|---|---|---|
| 3,456,913 | A * | 7/1969 | Lutz | 249/63 |
| 3,935,955 | A * | 2/1976 | Das | 215/375 |
| 4,174,782 | A * | 11/1979 | Obsomer | 215/373 |
| 5,713,480 | A * | 2/1998 | Petre et al. | 215/373 |
| 6,585,123 | B1 * | 7/2003 | Pedmo et al. | 215/373 |
| 6,595,380 | B2 * | 7/2003 | Silvers | 215/373 |
| 6,983,858 | B2 * | 1/2006 | Slat et al. | 215/373 |
| 7,140,505 | B2 * | 11/2006 | Roubal et al. | 215/373 |
| D546,699 | S * | 7/2007 | Bourne | D9/552 |

(Continued)

FOREIGN PATENT DOCUMENTS

| | | |
|---|---|---|
| FR | 2 888 563 A1 | 1/2007 |
| WO | 2004/028910 A1 | 4/2004 |

*Primary Examiner* — Tri Mai
(74) *Attorney, Agent, or Firm* — Sughrue Mion, PLLC

(57) ABSTRACT

Plastic container (1), characterized in that it comprises:
a rigidified body (5),
a bottom (8) extending to a lower end of the container (1) and comprising:
an annular base (9) extending substantially perpendicular to the body (5) in the prolongation thereof;
an annular step (10) extending from the base (9) towards the interior of the container (1),
a recess (12) at the center of the bottom (8) projecting towards the interior of the container (1),
a deformable annular membrane (11) in the shape of a spherical cap extending substantially perpendicular to the body (5) between the step (10) and the recess (12).

17 Claims, 13 Drawing Sheets

(56) References Cited

U.S. PATENT DOCUMENTS

| | | | | |
|---|---|---|---|---|
| 7,543,713 | B2 * | 6/2009 | Trude et al. | 215/373 |
| 7,799,264 | B2 * | 9/2010 | Trude | 264/524 |
| 8,152,010 | B2 * | 4/2012 | Melrose | 215/373 |
| 8,276,774 | B2 * | 10/2012 | Patcheak et al. | 215/373 |
| 2005/0082250 | A1 * | 4/2005 | Tanaka et al. | 215/374 |
| 2006/0006133 | A1 * | 1/2006 | Lisch et al. | 215/374 |
| 2006/0138074 | A1 * | 6/2006 | Melrose | 215/373 |
| 2006/0138075 | A1 * | 6/2006 | Roubal et al. | 215/373 |
| 2007/0199915 | A1 * | 8/2007 | Denner et al. | 215/375 |
| 2007/0215571 | A1 * | 9/2007 | Trude | 215/373 |
| 2008/0197105 | A1 | 8/2008 | Boukobza | |

* cited by examiner

CONTAINER COMPRISING A BOTTOM EQUIPPED WITH A DEFORMABLE MEMBRANE

CROSS REFERENCE TO RELATED APPLICATIONS

The application is a National Stage of International Application No. PCT/FR2008/001131 filed Jul. 29, 2008, claiming priority based on French Patent Application No. 07/05554, filed Jul. 30, 2007, of contents of all of which are incorporated herein by reference in their entirety.

The invention relates to the manufacture of containers, such as bottles or jars, produced by blow molding or stretch-blow molding from preforms made of thermoplastic material.

Conventional stretch-blow molding induces a bi-orientation of the material (axial and radial) which confers good structural rigidity to the final container. However, this bi-orientation induces residual stresses in the material which are released during hot-filling (particularly with a liquid having a temperature higher than the glass transition temperature of the material), causing a deformation of the container that could make it unsuitable for sale.

To decrease deformation of the container during hot-filling, it is known to complete the stretch-blow molding through a thermal treatment called heat set, by which the just-formed container is held in contact with the wall of the heated mold at a temperature between 120° C. and 250° C. for a predetermined time (generally several seconds).

However, heat set resolves only part of the problems of deformation of the container related to hot-filling. Indeed, while cooling, the liquid and the air above the liquid in the capped container undergo a decrease in volume that tends to make the container retract.

Several solutions have been considered for decreasing the visible effects of such retraction. These solutions generally concern the shape of the container.

Thus, it has been proposed to equip the body of the container with deformable panels that bend under the effect of the retraction.

More recently, it has been proposed (see U.S. Pat. No. 6,896,147 and American patent applications US 2006/138074 and US 2006/006133) to give the bottom of the container a special shape capable of absorbing at least part of the deformation due to retraction.

However, the known solutions appear to be insufficient given the ever more demanding criteria of visual quality imposed by the distributors.

Also, an objective of the invention is to improve the mechanical and/or aesthetic properties of containers for use in hot-filling.

To that end, the invention proposes a plastic container comprising:

- a rigidified body,
- a bottom extending to a lower end of the container and comprising:
  - an annular base extending substantially perpendicular to the body in the prolongation thereof;
  - an annular step extending from the base towards the interior of the container,
  - a recess at the center of the bottom projecting towards the interior of the container,
  - a deformable annular membrane in the shape of a spherical cap extending substantially perpendicular to the body between the step and the recess.

According to a particular embodiment, the bottom comprises ribs preferably having a V-shaped cross section and extending at least in part radially and protruding on the membrane towards the interior of the container.

Moreover, the bottom can comprise a flat region extending from the step, and a counter step extending from the flat region and in which the ribs are anchored at an external end.

The ribs can extend radially or have two radial sections connected by a curved intermediate section.

Furthermore, the bottom can comprise a central rib, preferably having a V-shaped cross section and dividing the membrane into two parts, i.e. a central part surrounding the recess and a peripheral part surrounding the central part.

According to one embodiment, the ribs extend protruding on the peripheral part of the membrane; they can be anchored in the central rib, or tangents thereto.

Prior to filling, the membrane can have a cavity turned towards the interior, or on the contrary, turned towards the exterior of the container. Its radius of curvature is preferably between 50 mm and 150 mm. For example, this radius of curvature is approximately 100 mm.

Moreover, the container can be heat set.

Other objects and advantages of the invention will appear from the following description, with reference to the appended drawings in which FIG. 1 is an elevation view of a plastic container, according to a first embodiment;

Figure 1:
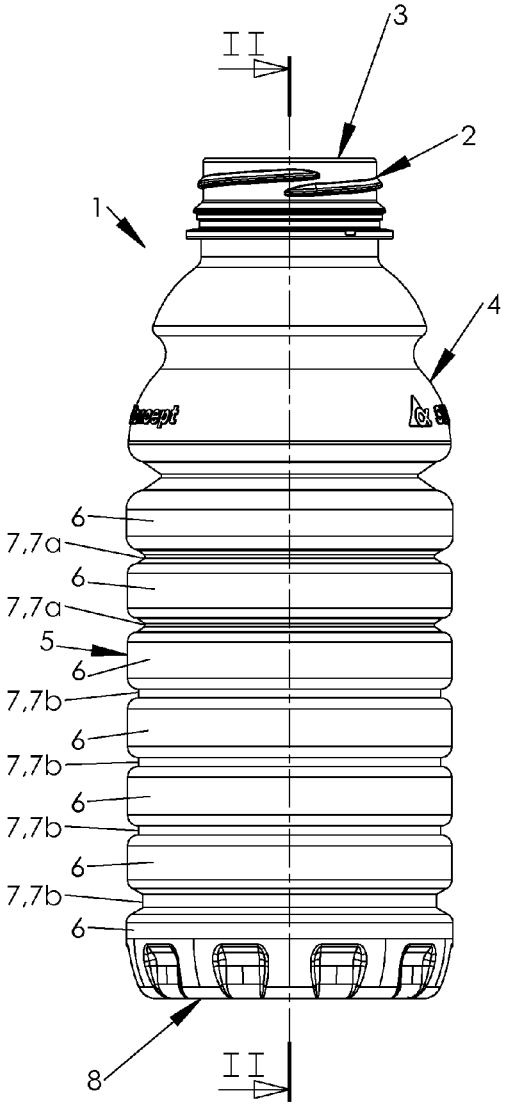

Represented in FIG. 1 is a container 1—in this instance a wide neck bottle with a capacity of about 0.6 l—produced by stretch-blow molding a preform of thermoplastic material such as PET (polyethylene terephthalate).

Said container 1 comprises, at an upper end, a threaded neck 2 having a wide mouth 3. In the prolongation of the neck 2, the container 1 comprises in its upper part a shoulder 4 being extended by a side wall or body 5, generally cylindrical in revolution around a principal axis X of the container 1.

Figure 2:
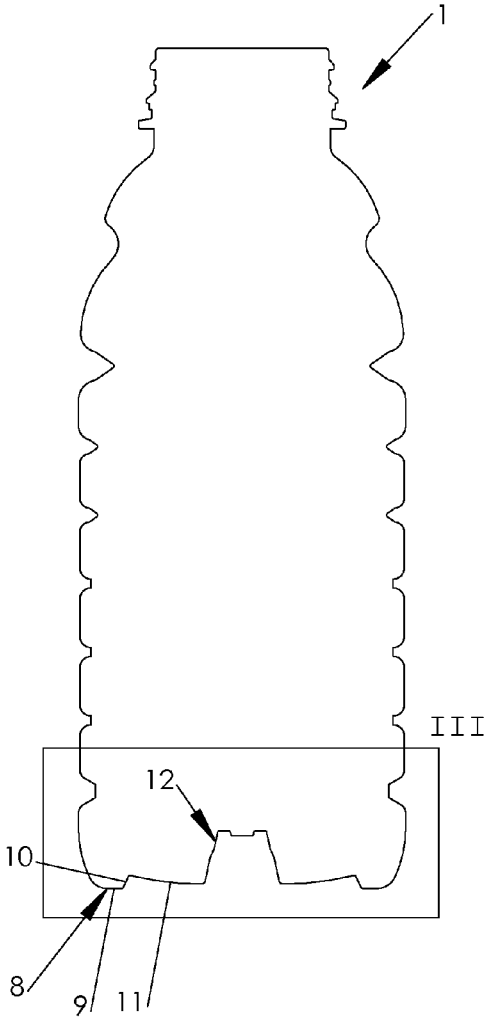
FIG. 2 is a cross sectional view of the container of FIG. 1, taken along the line II-II.

As can be seen in FIGS. 1 and 2, the body 5 comprises a succession of stiffeners 6 in the form of annular ribs separated two by two by annular grooves 7. According to an embodiment illustrated in FIGS. 1 and 2, some grooves 7*a* located near the shoulder 4 (in this instance, the two grooves 7*a* closest to the shoulder 4) have a V-shaped profile to give to the container 1 radial stiffness while still allowing an axial retraction thereof in this region, while the subsequent grooves 7*b*, in the central part and lower part of the container 1, have a flat-bottomed U-shaped profile to give the container 1*a* stiffness that is both axial and radial.

The container 1 further comprises a bottom 8 that extends at a lower end of the container 1. The bottom 8 comprises an annular base 9, on which the container 1 can rest in a stable manner on a flat surface (such as a table) and which extends substantially perpendicular to the body 5 (or to the axis X of the container) in the prolongation thereof.

Figure 3:
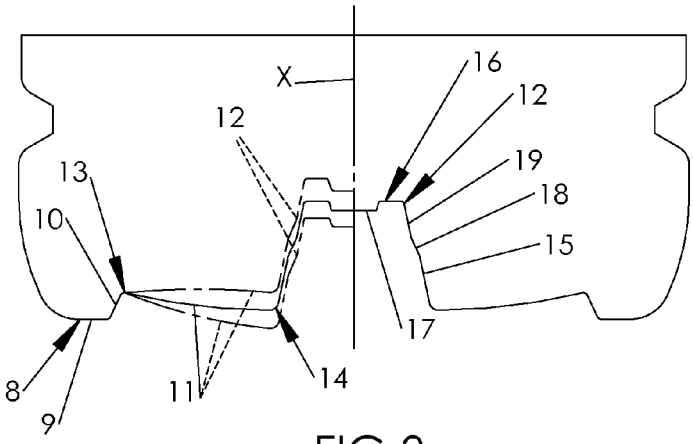
FIG. 3 is a detailed view in larger scale, showing the bottom of the container of FIG. 2.
Figure 4:
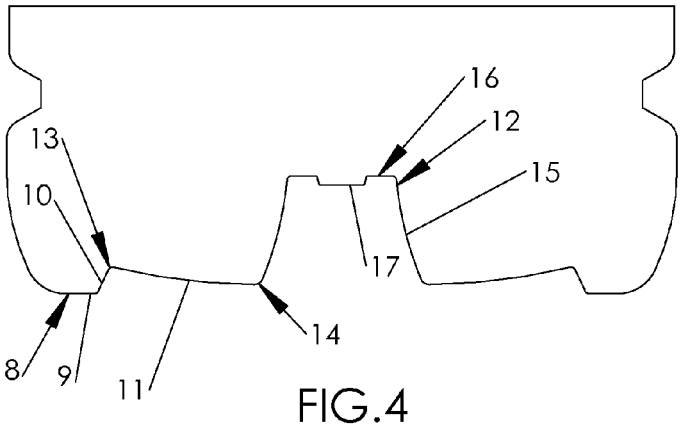
FIG. 4 is a view similar to FIG. 3, according to a variation of embodiment.
Figure 5:
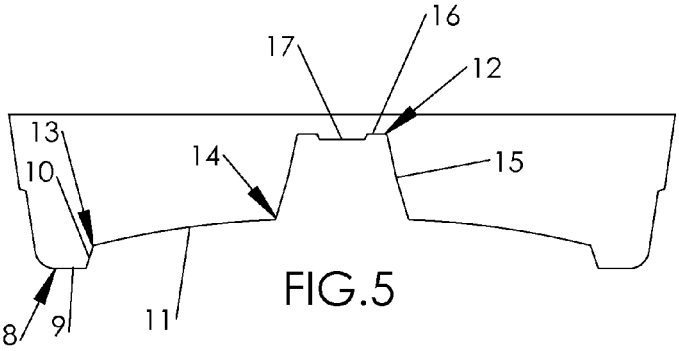
FIG. 5 is a view similar to FIGS. 3 and 4, according to a second embodiment.
Figure 6:
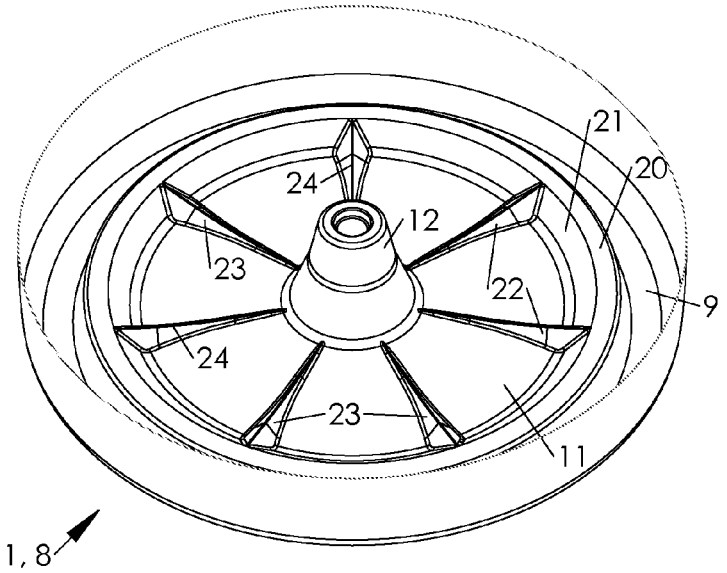
FIG. 6 is a partial view in perspective of a container, showing from above (that is, from the interior of the container) the bottom thereof, according to a third embodiment.
Figure 7:
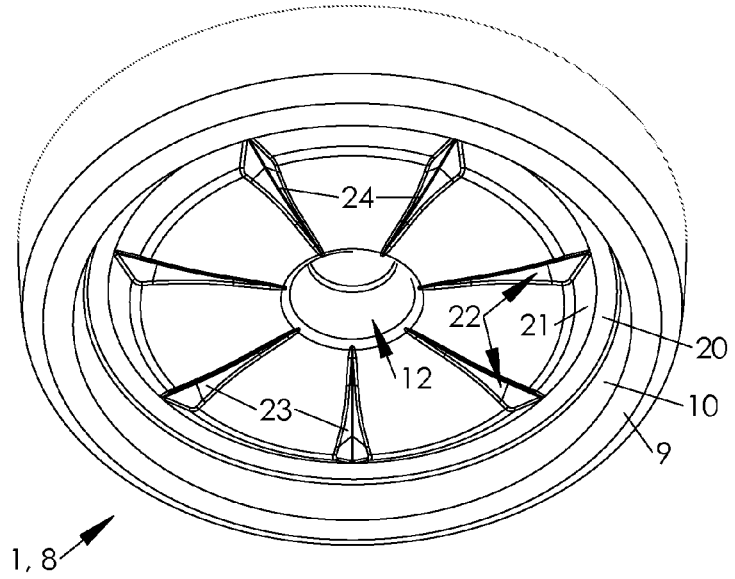
FIG. 7 is a view in perspective from below (from the exterior of the container) of the bottom of the container shown in FIG. 6.
Figure 8:
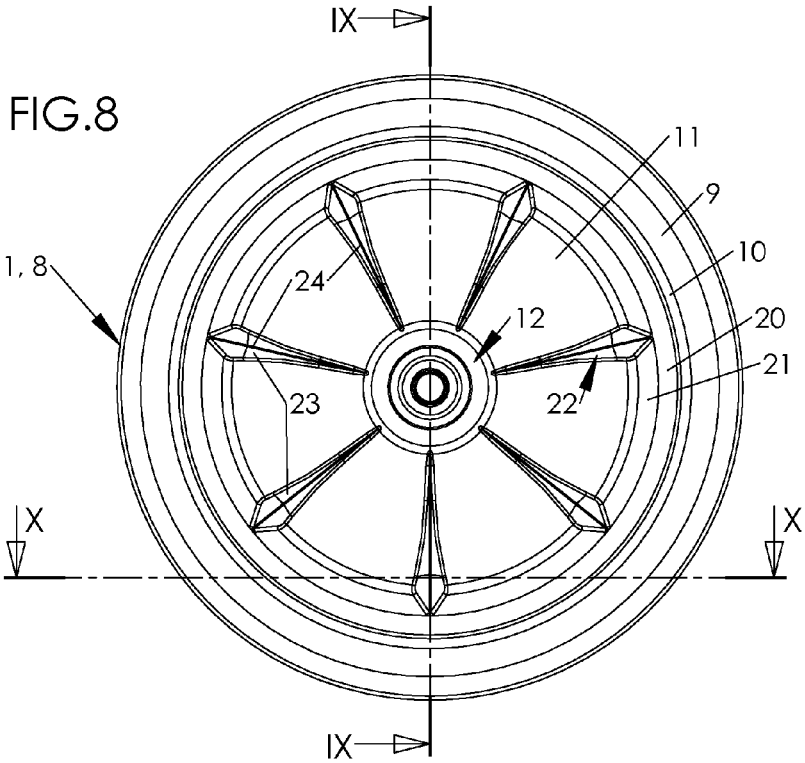
FIG. 8 is a view from below of the bottom of the container of FIGS. 6 and 7.

The bottom 8 further comprises an annular step 10, which extends from the base 9, in the prolongation thereof towards the interior of the container 1. As illustrated in FIGS. 3, 4 and 5, the step 10 is preferably in the shape of a truncated cone; the angle at the top of this step is between 30° and 90°.

The bottom 8 further comprises an annular membrane 11 which extends in the prolongation of the step 10 towards the axis of the container 1, substantially perpendicular to the body 5 (or to the axis X).

Finally, the bottom 8 comprises, at its center and in the prolongation of the membrane 11, a central recess 12 that projects into the interior of the container 1.

More specifically, the membrane 11 has, at the junction with the step 10, a circular outer edge 13, and at the junction with the recess 12, a circular inner edge 14.

According to a first embodiment illustrated in FIGS. 3 and 4, the membrane 11, prior to the hot-filling of the container 1, is concave with the concavity turned towards the interior thereof. When the container 1 is considered to be in the vertical position, for example placed flat on a flat support surface such as a table, the inner edge 14 of the membrane 11 appears situated below the exterior edge 13, although the interior edge 14 does not extend beyond the plane of the base 9.

According to a second embodiment, illustrated in FIG. 5, the membrane 11, prior to the hot-filling of the container 1, is convex, i.e. its concavity is turned towards the exterior of the container 1. When the container 1 is considered to be in the vertical position, for example placed flat on a flat support such as a table, the interior edge 14 of the membrane 11 appears situated above the exterior edge 13.

As illustrated in FIGS. 3 to 5, the membrane 11 is preferably in the form of a spherical cap, of symmetry of revolution around the principal axis X of the container and whose radius of curvature is between 50 mm and 150 mm.

The expression "spherical cap" here refers to a curved surface for which the radius of curvature is substantially continuous, i.e. the concavity does not change on the surface.

More specifically, in the first embodiment illustrated in FIGS. 3 and 4, the radius of curvature of the membrane 11 is preferably between 60 and 80 mm, for example approximately 70 mm. In the second embodiment illustrated in FIG. 5, the radius of curvature of the membrane 11 is preferably between 80 mm and 120 mm, for example approximately 100 mm.

The recess 12 has a side wall 15 that is generally conical in shape, surmounted by a substantially flat top 16 of a circular contour, at the center of which is a disc 17 of non-stretched amorphous material, corresponding to the injection point of the preform from which the container is manufactured.

According to one embodiment illustrated in FIG. 3, the side wall 15 of the central recess 12 is not smooth but has a broken profile and comprises, substantially at mid-height, a recess 18, the wall 15 having a narrowed zone 19 near the top 16 as a result of this.

According to a variation of embodiment, illustrated in FIG. 4, the side wall 15 is concave with the concavity turned opposite to the principal axis X of the container 1.

These non-limiting variations of embodiment of the central recess 12, compared to a smooth-walled conical profile, provide the advantage of increasing the stretching of the material in the vicinity of the center of the bottom 8.

In that way, the amorphous part of the bottom 8 is located on the top 16 of the recess 12, while the surrounding parts (i.e. the side wall 15 of the recess 12, the membrane 11, the step 10 and the base 9) are comparatively crystalline, which minimizes the uncontrolled deformations of the bottom 8 of the container 1 during hot-filling.

During hot-filling with a liquid or paste at a temperature above the glass transition temperature of the material of which the container 1 is constituted (i.e. approximately 75° C. for a PET), the body 5 substantially preserves its initial shape due to the presence of the stiffeners 6 which, by increasing the radial stiffness of the container 1, limit the ovalization thereof. The essentially crystalline bottom 8 (except for the top 16 of the recess 12), does not undergo deformation due solely to the effect of the temperature of the fill liquid, unlike the essentially amorphous bottom of a conventional container.

However, under the combined effect of the hydrostatic pressure and the temperature of the fill liquid, the bottom 8 is deformed at first by bending the membrane 11, articulated around its outer edge 13, accompanied by a pushing down of the recess 12. This bending can possibly result in a configuration—which is temporary—where the inner edge 14 of the membrane 11 projects beyond the plane of the base 9. This intermediate configuration is represented by broken lines in FIG. 3.

Then, in a second phase, with the cooling and contraction of the liquid (according to the laws of thermodynamics), the bottom 8 rises again from its intermediate configuration described above, to a final configuration in which the membrane 11 subsides in the opposite direction around its outer edge 13, the recess 12 rising again to beyond its initial position (i.e. prior to filling). In this final configuration, in the case of the first embodiment described above, the membrane 11 can have its curvature reversed with respect to its initial configuration, i.e. its concavity is turned towards the exterior of the container 1, as illustrated by broken lines in FIG. 3.

The combined presence of annular stiffeners 6 in the form of ribs on the body 5 and a deformable membrane 11 in the bottom 8 results in the deformations being localized on the bottom 8, first during the hot-filling, then during the subsequent cooling of the liquid.

These characteristics can suffice to give the container 1 good mechanical strength, but it is still preferable to increase the structural rigidity by means of heat-setting, which increases the rate of crystallinity of the material.

Moreover, in addition to the effect of such heat setting, the crystallinity of the bottom 8 can be increased mechanically by a method called boxing in a mold fitted with a mold bottom sliding parallel to the axis X of the container 1. According to this method, the mold bottom is first placed in a low position situated below its final position, which makes it possible first to stretch the bottom 8 of the container 1 beyond its final position. The mold is then raised again to give the bottom 8 its final shape while stretching the material to the maximum. A description of a method of this type can be found in the document FR 2 508 004.

A container 1 according to a third embodiment will now be described, with reference to FIGS. 6 to 10. The elements that are structurally or functionally similar or identical to the elements of the previously described embodiments are referenced in an identical manner.

As can be seen in FIGS. 6 to 9, the bottom 8 comprises a substantially flat annular base 9, encircled towards the axis of the container 1 by a step 10 of truncated conical shape whose angle at the top, as previously indicated, is between 30° and 90°.

The step 10 is extended, towards the axis of the container 1, by a flat region 20 which, at rest (i.e. in the absence of stress being exerted on the container 1—in practice, prior to the filling) is a truncated conical shape at a very open angle. More specifically, as illustrated in the portion to the right of FIG. 9, the angle $\alpha$ formed by a generatrix of the flat region 20 with a horizontal plane perpendicular to the axis of the container 1 is between 3° and 10°, and preferably between 5° and 7°. According to a preferred embodiment, this angle is approximately 6°.

The flat region 20 is extended towards the axis of the container 1 by a counter step 21 of truncated conical shape, its concinnity reversed with respect to the step 10, the counter step 21 extending towards the exterior of the container 1 from the flat region 20. At rest, the angle at the top of the counter step 21 is between 80° and 120°, and preferably between 90° and 110°. According to a preferred embodiment, said angle is approximately 100°. Moreover, as can be seen in FIG. 9, the junction between the counter step 21 and the membrane 11 is offset, with respect to the base 9, towards the interior of the container 1.

The membrane 11, which connects the counter step 21 to the central recess 12, as in the embodiments previously described, has the shape of a spherical cap. In the example shown, corresponding to a preferred embodiment, the concavity of the membrane, when at rest, is turned towards the exterior of the container 1. Furthermore, the membrane is formed in such a way that, at rest, in the normal vertical position of the container 1, the base of the recess 12 being [sic] situated comparatively higher than the junction between the membrane 11 and the counter step 21.

As shown in FIGS. 6 to 10, the bottom 8 is also provided with ribs 22 that project from the membrane 11 towards the interior of the container 1 and extend radially from the base of the recess 12 up to the counter step 21. The ribs 22 are preferably uniformly distributed around the axis of the container 1. In order to ensure the proper functioning of the bottom 8 (see below), said bottom preferably has more than three ribs 22. For example, the number of ribs 22 is seven, as illustrated in FIGS. 6 to 9.

Figure 9:
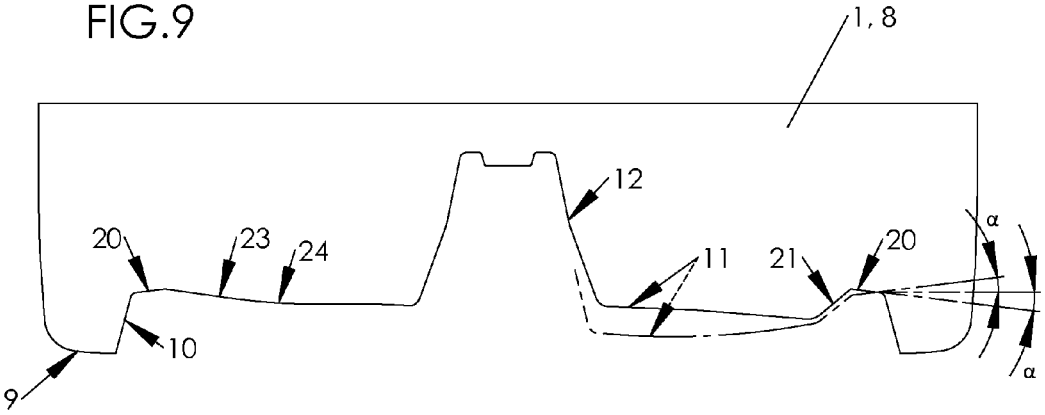
FIG. 9 is a cross sectional view in larger scale of the container of FIG. 8, taken along the line IX-IX.

Viewed from above, each rib 22 is in the shape of a spearhead and comprises two sides 23, substantially flat, joined by a ridge 24 that extends in a radial plane and whose profile is slightly curved downward (in the normal position of the container 1), as can be seen in the left part of FIG. 9.

Figure 10:
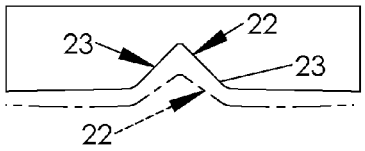
FIG. 10 is a detailed view in partial cross section, in larger scale, of the bottom of the container of FIG. 8, taken along the line X-X.

As illustrated in FIG. 10, the sides 23 are sloping with respect to a radial plane, each rib 22 having in transverse cross section (see FIG. 10) a V-shaped profile with concavity turned towards the exterior of the container 1, the angle at the top between the sides 23 being, at rest, between 80° and 100°, and preferably approximately 90°.

At an outer end, each rib 22 is anchored in the counter step 21 and extends over the entire height thereof, the ridge 24 rejoining the counter step 21 at its junction with the flat region 20.

The bottom 8 thus structured can be provided on a container 1 whose body 5 is ribbed, as illustrated in FIG. 1, or smooth, as illustrated in FIGS. 27 to 30 which are distinguished from each other by different curves of the body 5. In this second case, in order to confer sufficient structural rigidity of the body 5 to transfer to the bottom 8 most of the deformations resulting from the stresses to which the container 1 is subjected during hot-filling, the body 5 has a thickness [similar] to common containers, including containers normally designated to be heat resistant or HR. in practice, care should be taken that the thickness of the body be greater than approximately 4/10 mm, a thickness of between 4/10 mm and 9/10 mm being considered satisfactory.

During hot-filling of the container 1, under the conditions indicated above, the body 5 substantially preserves its initial shape due either to the presence of the stiffeners, or to its thickness.

Under the combined effect of the hydrostatic pressure and the temperature of the fill liquid, the bottom 8 is deformed at first by reversal of the angle $\alpha$ of the flat region 20, together with the bending of the counter step 21 and the membrane 11, with a possible inversion of the concavity thereof, accompanied by a pushing down of the recess 12, however without the base of said recess 12 projecting beyond the plane of the base 9 (see the respective configuration illustrated by broken lines in FIG. 9). At the same time, the ribs 22 flatten out, their angle at the top opening as the membrane 11 bends (see the configuration illustrated by broken lines in FIG. 9).

Then, in a second phase, with the cooling of the liquid and its contraction, the bottom 8 rises again to a position above its initial position prior to the reversal due to the hot filling, while the ribs 22 tend to close again while contributing to the locking of the membrane 11 in its final position.

A container 1 according to a fourth embodiment will now be described, with reference to FIGS. 11 to 14. The elements that are structurally or functionally similar or identical to the elements of the embodiments previously described are referenced in an identical manner.

In this fourth embodiment, derived from the third embodiment that has just been described, the membrane 11 is still in the form of a spherical cap, but it is subdivided into two concentric parts 25, 26, to wit:

a central part 25, encircling the recess 12, and a peripheral part 26, which extends around the central part 25 between it and the counter step 21.

A central rib 27 forming a closed loop surrounding the recess 12, with V-shaped transverse cross section, extends to the junction between the central part 25 and the peripheral part 26, projecting towards the interior of the container 1. The central 25 and peripheral 25 parts are themselves spherical cap shaped, their concavity being turned in the same direction, so that the overall shape of the membrane 11 is more precisely that of a spherical cap comprising a fold formed by the rib 27.

Figure 14:
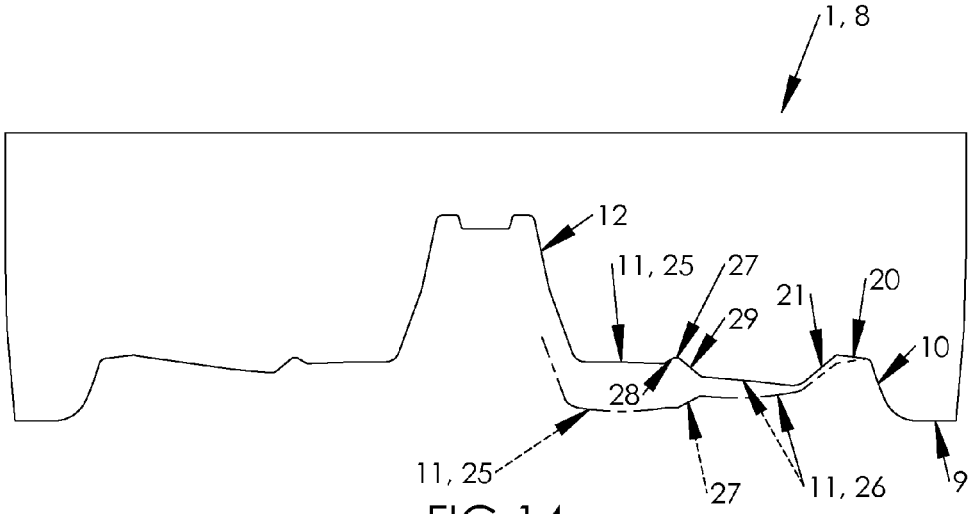
FIG. 14 is a cross sectional view in larger scale of the bottom of the container of FIG. 8, taken along a broken line XIV-XIV.
Figure 15:
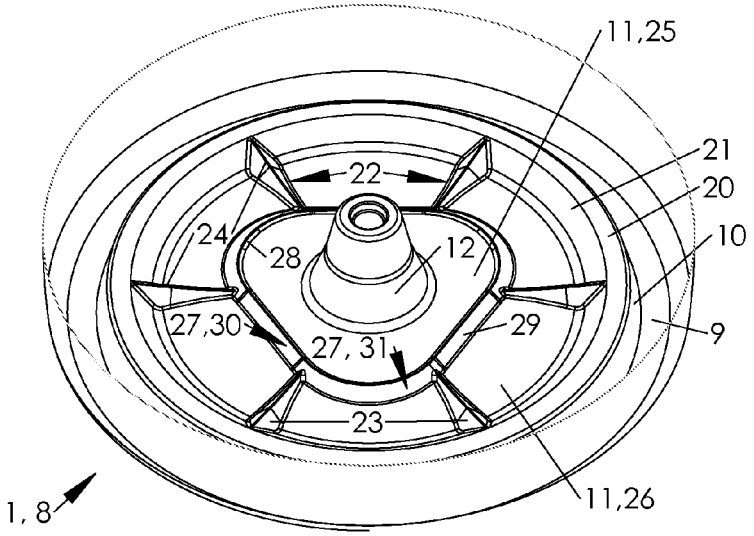
FIG. 15 is a partial view in perspective of a container, showing from above (i.e. from the interior of the container) the bottom thereof, according to a fifth embodiment.
Figure 16:
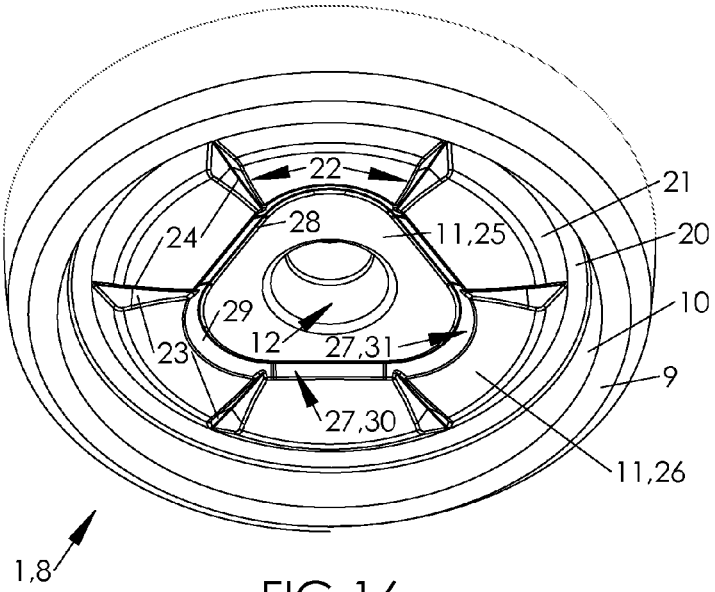
FIG. 16 is a view in perspective from below (from the exterior of the container) of the bottom of the container shown in FIG. 15.

The rib 27, of a circular profile in this instance, towards the central part 25, has an inner truncated cone-shaped side 28, and opposite it, towards the peripheral part 26, an outer truncated cone-shaped side 29. At rest, the angular opening of the V-shaped cross section of the rib 27 is preferably between 90° and 130°, and preferably between 100° and 120°. According to a preferred embodiment illustrated in the figures, the angle at the top of the cross section is approximately 110°. As can be seen in FIG. 14, the V-shaped profile of the central rib 27 is not symmetrical, the inner side 28 having a lesser vertical extension than the outer side 29. Thus, the central part 25 of the membrane 11 is situated, in the normal vertical position of the container 1 and at rest, slightly higher than the peripheral part 26.

Figure 11:
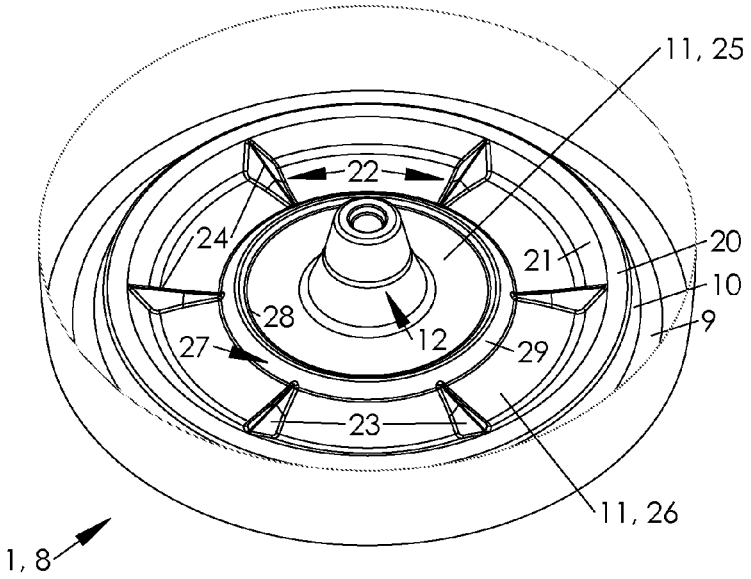
FIG. 11 is a partial view in perspective of a container, showing from above (i.e. from the interior of the container) the bottom thereof, according to a fourth embodiment.
Figure 12:
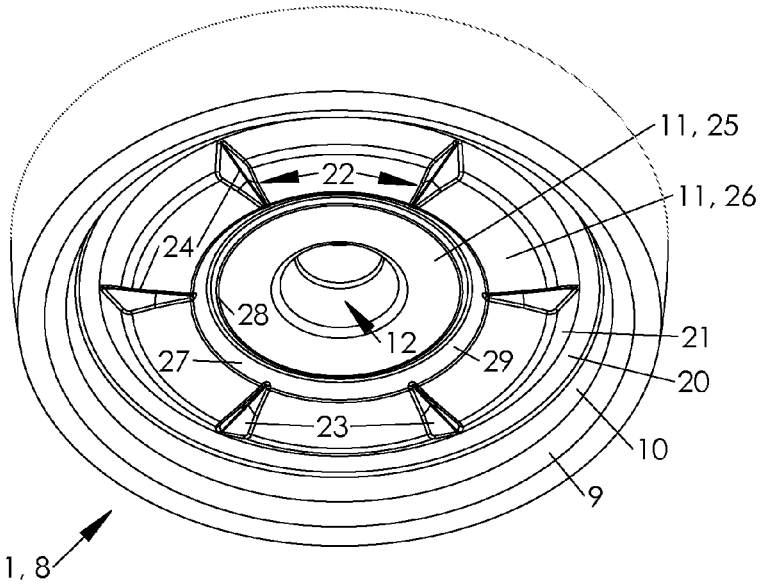
FIG. 12 is perspective view from below (from the exterior of the container) of the bottom of the container shown in FIG. 11.
Figure 13:
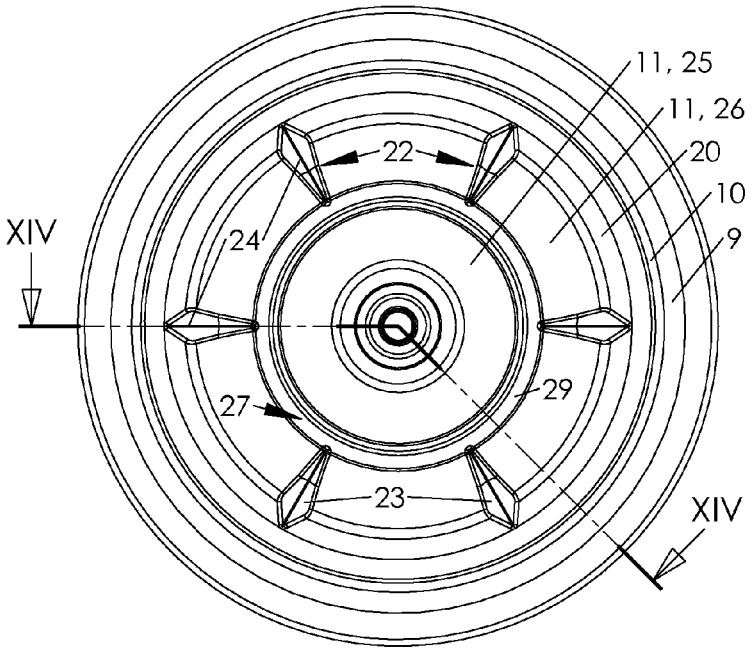
FIG. 13 is a view from below of the bottom of the container of FIGS. 11 and 12.

Furthermore, the bottom 8 is furnished with ribs 22 which project from the peripheral part 26 of the membrane 11 towards the interior of the container 1 and extend radially out from the central rib 27 to the counter step 21. The ribs 22 are preferably uniformly distributed around the axis of the container 1 and, for example, there are six of them (as can be seen in FIGS. 11 to 13).

As in the third embodiment described above, when viewed from above each rib 22 is shaped like a spearhead. The ridge 24, which joins the sides 23, extends from the base of the central rib 27 to the top of the counter step 21, at its junction with the flat region 20.

During a hot-filling of the container 1, under the conditions indicated above, the body 5 substantially preserves its initial shape due either to the presence of stiffeners or to its thickness.

Under the combined effect of the hydrostatic pressure and the temperature of the fill liquid, the bottom 8 is deformed in a first phase by the joint bending of the flat region 20, the counter step 21 and the peripheral part 26 of the membrane 11, accompanied by a joint pushing down of the central part 25 of the membrane and the recess 12.

In this temporary configuration, illustrated by broken lines in FIG. 14, in the normal vertical position of the container 1 the central part 25 can adopt a position lower than that of the peripheral part 26 of the membrane 11 as a result of the deformation—which can go as far as reversal—of the central rib 27. The capacity of deformation of the membrane 11 is thus increased. At the same time, the ribs 22 flatten out, their angle at the top opening out as the peripheral part 26 of the membrane 11 bends.

Then, in a second phase, with the cooling of the liquid and its contraction, the bottom 8 rises again from its temporary configuration described above to a final configuration where the membrane 11 is again substantially in its initial shape while the ribs 22 tend to close up again, contributing to the locking of the peripheral part 26 of the membrane 11 in its final position. In the same way, the central rib 27 tends to close up again, contributing to the locking of the central part 25 in a raised position compared to the peripheral part 26.

A container 1 according to a fifth embodiment will now be described, with reference to FIGS. 15 to 18. The elements that are structurally or functionally similar or identical to the elements of the embodiments described above are referenced in an identical manner.

This fifth embodiment is closely derived from the fourth embodiment just described, being distinguished by the shape—triangular with rounded tops instead of circular—of the central rib 27 separating the central part 25 of the membrane 11 from its peripheral part 26.

Figure 17:
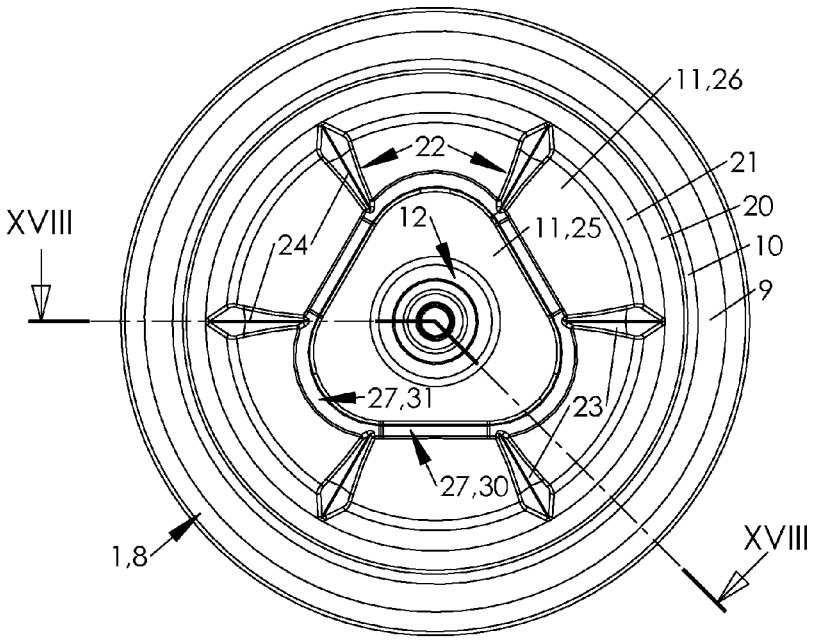
FIG. 17 is a view from below of the bottom of the container of FIGS. 15 and 16.
Figure 18:
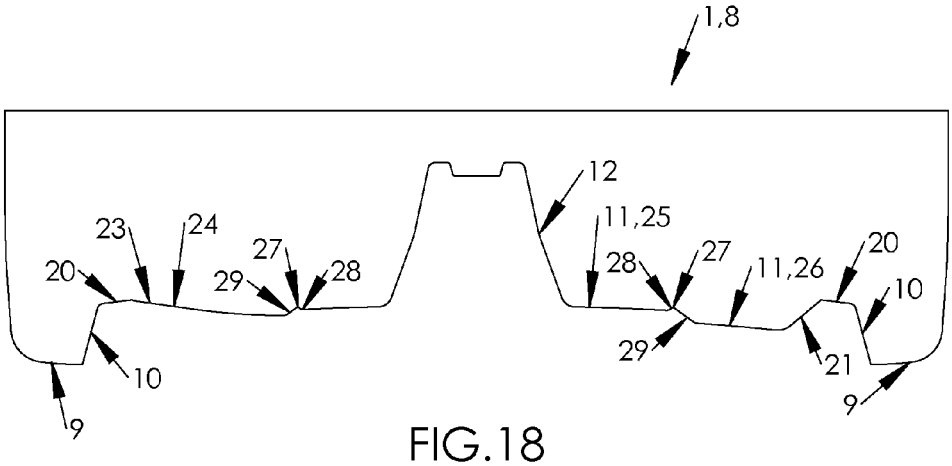
FIG. 18 is a cross sectional view in large scale of the bottom of the container of FIG. 17, along a broken line XVIII-XVIIII.

As can be seen in FIG. 17, the radial ribs 22, of which there are six, are anchored towards the interior to the junctions between the straight sections 30 and the curved sections 31 of the central rib 27.

During hot-filling, the bottom 8 is deformed substantially in the same way as described previously for the fourth embodiment. However, the inventors observed better rigidity of the bottom 8 in its final configuration (after the liquid has cooled), to which the triangular shape of the central rib 27 contributes. More specifically, the curvature of the curved sections 31 (top view, see FIG. 17), which is comparatively less than the curvature of the circular profile presented in the fourth embodiment, tends to increase the structural rigidity of the rib 27.

A container 1 according to a sixth embodiment will now be described, with reference to FIGS. 19 to 22. The elements that are structurally or functionally similar or identical to the elements of the embodiments described above are referenced in an identical manner.

In this sixth embodiment, derived from the third embodiment described above, the membrane 11 is still presented in the form of a spherical cap on which ribs 22—which have a different profile, however —are provided, projecting towards the interior of the container 1.

Figure 19:
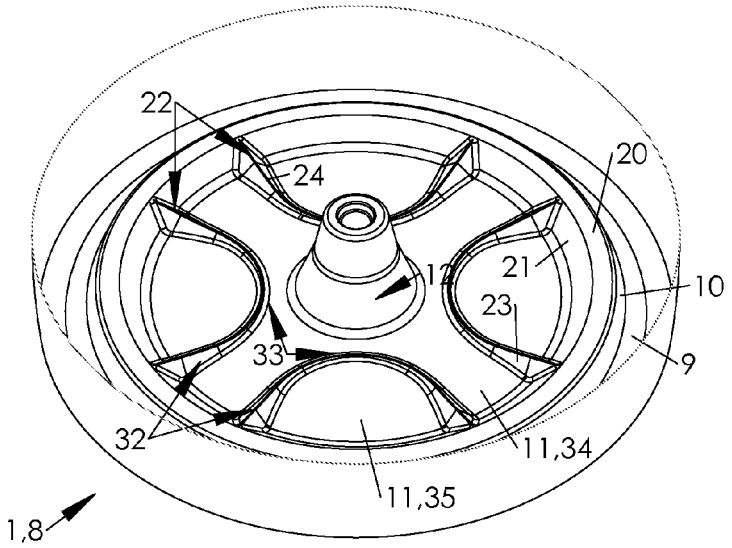
FIG. 19 is a partial view in perspective of a container, showing from above (i.e. from the interior of the container) the bottom thereof, according to a sixth embodiment.
Figure 20:
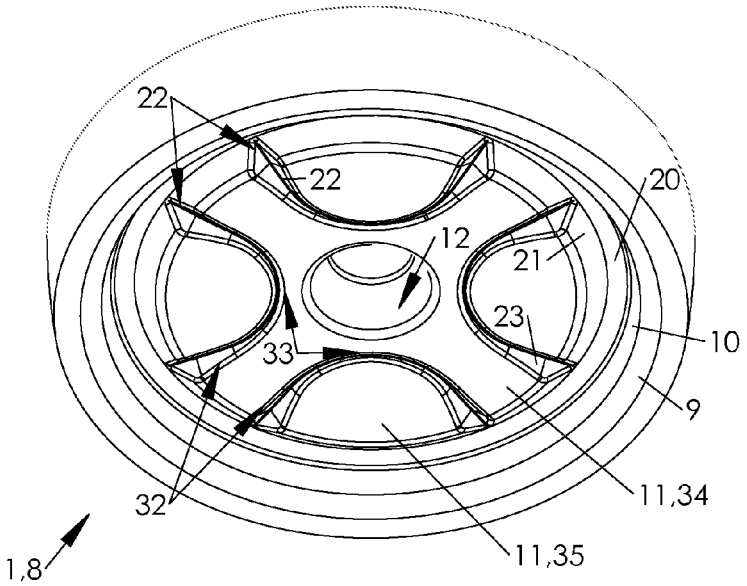
FIG. 20 is a view in perspective from below (from the exterior of the container) of the bottom of the container shown in FIG. 19.
Figure 21:
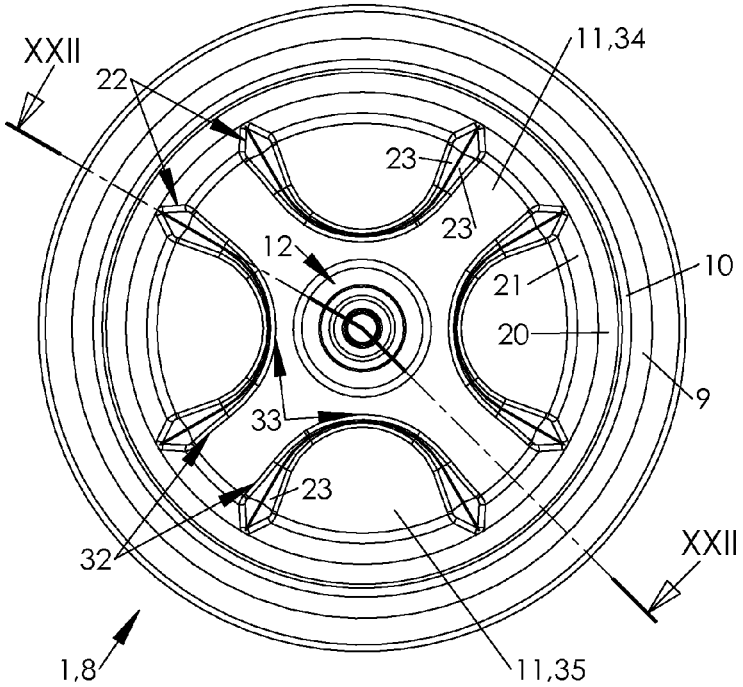
FIG. 21 is a view from below of the bottom of the container of FIGS. 19 and 20.
Figure 22:
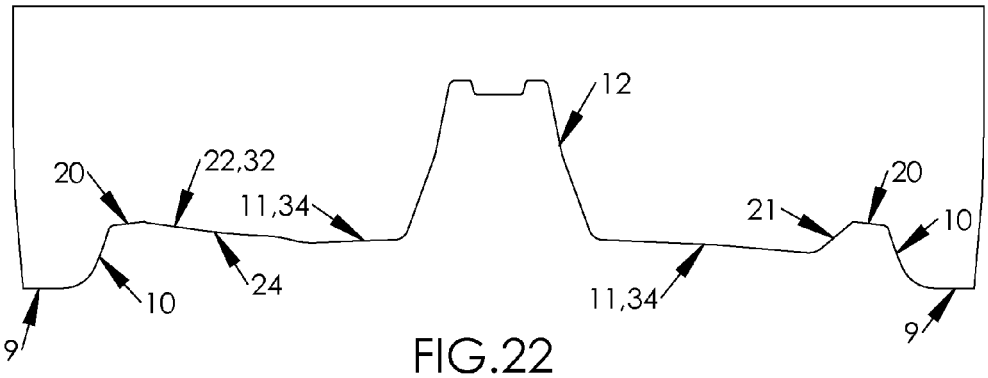
FIG. 22 is a cross sectional view in larger scale of the bottom of the container of FIG. 21, taken along a broken line XXII-XXII.

Indeed, as can be seen in FIGS. 19 to 21, each rib 22 comprises:

two radial sections 32 having a spearhead profile, spaced around the circumference of the membrane 11 and anchored, at an outer end, in the counter step 21.

an arched intermediate section 33, which connects the radial sections 32 of the side of the recess 12, thus giving a U-shaped profile to the rib when viewed from above (see FIG. 21). It should be noted that this intermediate section 33 is thinner, when viewed from above, than the radial sections 32.

Several grooves 22 (for example, four in number, as illustrated in FIG. 21) being provided on the membrane 11, distributed around the axis of the container 1, the membrane is thus subdivided into several zones, to wit:

a principal zone 34, in the form of a cross (with four branches in this instance), delimited by the ribs 22 and the counter step 21 and including the recess 12, several localized peripheral zones 35, each individually delimited at the interior by a groove 22 and at the exterior by the counter step 21, and thus when viewed from above (see FIG. 21) having a shape of a biconvex lens.

During a hot-filling of the container 1, under the conditions indicated above, the body 5 preserves substantially its initial shape due either to the presence of stiffeners or to its thickness.

The membrane 11 is deformed under the combined effect of the hydrostatic pressure and the temperature of the fill liquid. Due to its structure as it has just been described, the membrane 11 is deformed in a non-isotropic manner. More precisely, subject to strong hydrostatic pressure, the principal zone 34 including the recess 12 subsides at the same time as the sections of the flat region 20 and of the counter step 21 in which the principal zone 34 is anchored jointly bend downwards (in the manner described for the third embodiment and illustrated by broken lines in FIG. 9). Once the deformation of the principal zones 34 has taken place, the peripheral zones 35 pivot around the radial section of the ribs 22 in order to give additional movement. In this temporary deformed configuration, the ribs 22 are deformed, their angle at the top opens out as the principal zone 34 of the membrane 11 subsides.

Then, in a second phase, with the cooling of the liquid and its contraction, the principal zone 34 rises again to a position above that of its initial position before the hot-filling. The ribs 22 tend to reclose, contributing to the locking of the principal zone 34 of the membrane 11.

A container 1 according to a seventh embodiment will now be described, with reference to FIGS. 23 to 26. The elements that are structurally or functionally similar or identical to the elements of the embodiments described above are referenced in an identical manner.

In this seventh embodiment, closely derived from the fifth and sixth embodiments described above, the bottom 8 is distinguished from the bottom 8 described in the sixth embodiment by the presence of a central rib 27 of rounded triangular profile, as described in the fifth embodiment.

Figure 23:
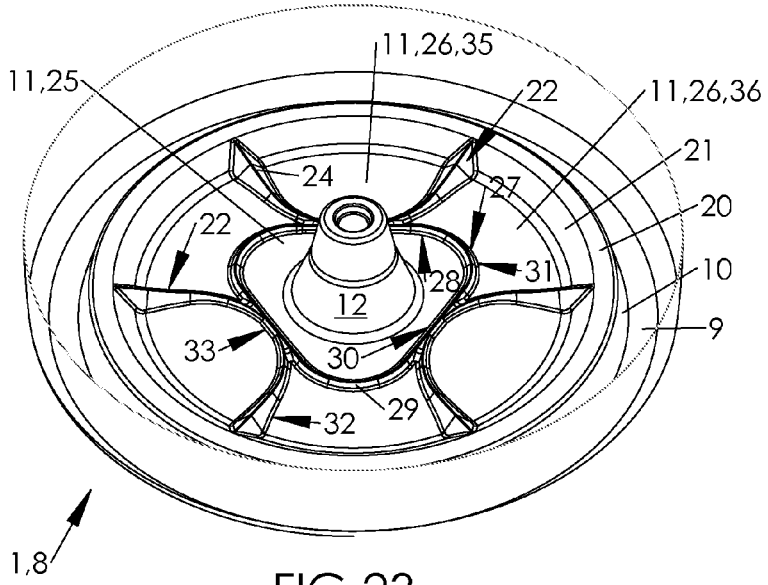
FIG. 23 is a partial view in perspective of a container showing from above (i.e. from the interior of the container) the bottom thereof, according to a seventh embodiment.
Figure 24:
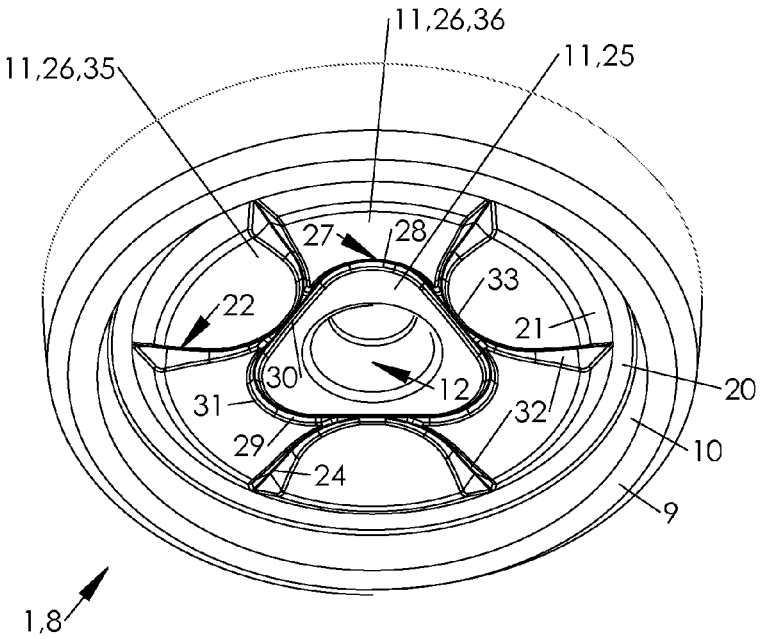
FIG. 24 is a view in perspective from below (from the exterior of the container) of the bottom of the container shown in FIG. 23.
Figure 25:
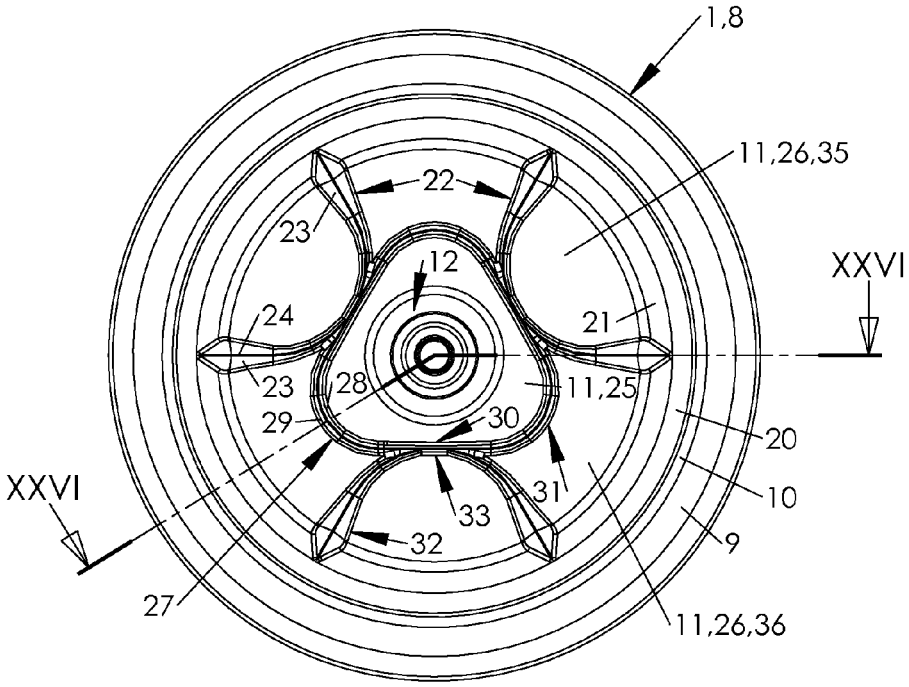
FIG. 25 is a view from below of the bottom of the container of FIGS. 23 and 24.
Figure 26:
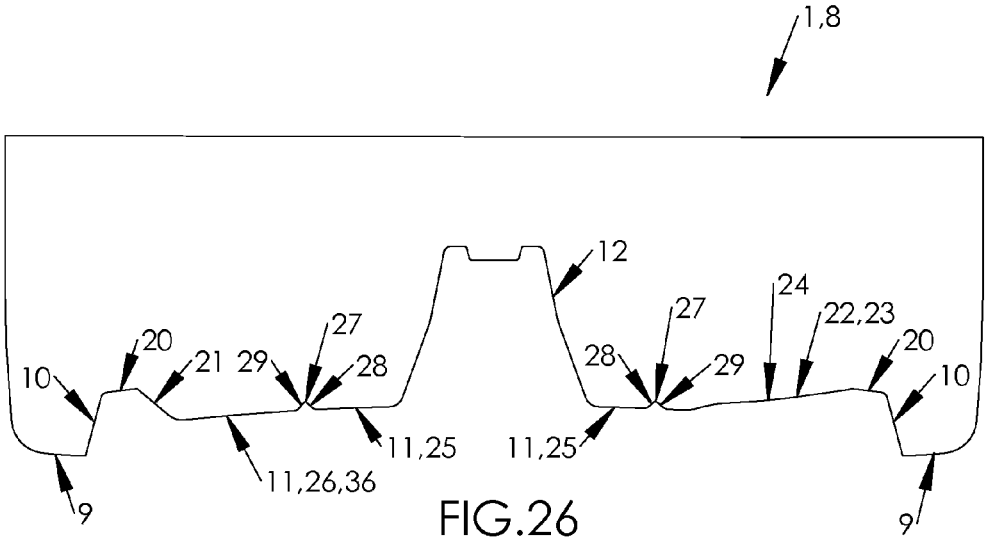
FIG. 26 is a cross sectional view in larger scale of the bottom of the container of FIG. 25, taken along a broken line XXVI-XXVI.
Figure 27:
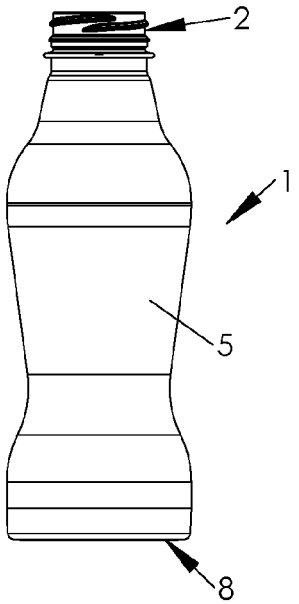
FIGS. 27 to 30 show possible variations of embodiment of the containers whose bottoms are illustrated in the preceding figures, depending on the shape that body may take.
Figure 28:
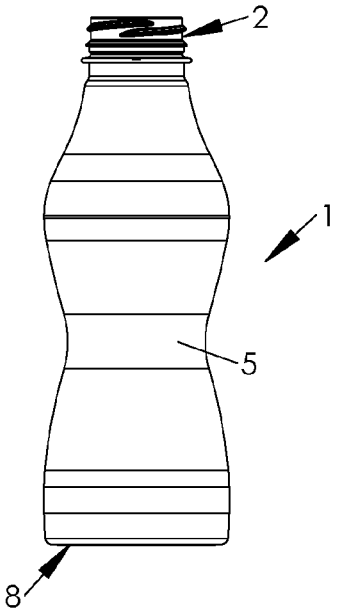
Figure 29:
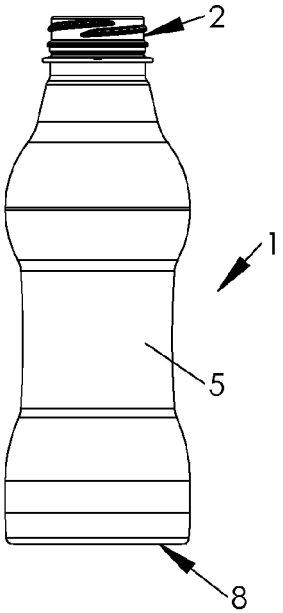
Figure 30:
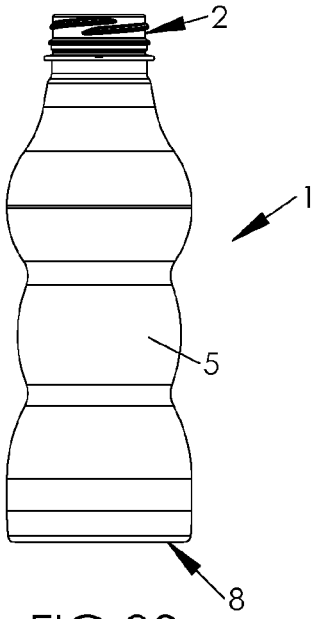

As can be seen in FIGS. 23 to 25, the intermediate sections 33 of the ribs 22 are tangential to the straight sections 30 of the central rib 27.

The membrane 11 is thus divided into two zones, to wit:

a central part 25, surrounding the recess 12, and a peripheral part 26, which extends around the central part 25 between it and the counter step 21, said peripheral part 26 itself being subdivided into several zones of two types:

principal zones 35 delimited jointly by the ribs 22 and the counter step 21, as in the sixth embodiment, and adjoining principal zones 36, situated between the zones 35 and delimited jointly by the ribs 22, the curved sections 31 of the central rib 27 and the radial sections 32 of the ribs 22.

During a hot-filling under the conditions described above, the central part 25 of the membrane 11 subsides below the peripheral part 26. The rib 27 first facilitates the subsiding of the central part 25 during the filling, then, in reinforcement of the ribs 22, contributes to the locking of the central part 25 in its final position once the liquid has cooled.

In all of the embodiments described above, when the container 1 is filled then cooled, the final position of the bottom 8 is substantially the same as the initial position. Indeed, in the final position the membrane 11 still forms a spherical cap, the concavity being substantially the same as in the initial position.

A bottom 8 according to any one of the embodiments that have just been described can be provided on a container 1 whose body 5 is ribbed as illustrated in FIG. 1, or on a container 1 whose body 5 is substantially smooth, i.e. it does not have ribs (FIGS. 27 to 29), but thicker, the ribbing or thickening of the body 5 fulfilling the function of structural rigidification, which prevents ovalization during hot-filling.

Consequently, by combining a smooth body 5 with the bottom 8 as described in accordance with any one of the seven embodiments, the deformations of the walls of the container 1 caused by the hot-filling are essentially concentrated on the bottom 8. This combination advantageously makes it possible to avoid the manufacture of a ribbed body 5. Indeed, for example in the case of manufacturing a container by blowing a preform in a mold, the manufacture of a mold for a ribbed body 5 is more expensive than for a smooth body 5. Moreover, a smooth body 5 has a better aesthetic appearance than a ribbed body 5.

The shape of the bottom 8, and more particularly the spherical shape of the membrane 11, enables a better control of the deformation of the bottom 8, both during hot-filling as well as during cooling.

The invention claimed is:

1. Plastic container, characterized in that it comprises:

a rigidified body, a bottom extending to a lower end of the container and comprising:

an annular base extending substantially perpendicular to the body in the prolongation thereof;

an annular step extending from the base towards the interior of the container, a recess at the center of the bottom projecting towards the interior of the container, wherein the recess includes a conically shaped side wall having a smooth-walled lower conical portion, a smooth-walled upper conical portion having a narrower shape than the lower conical portion, and a recessed portion extending completely around the recess along the side wall in a circumferential direction so as to divide the upper and lower conical portions from each other, a deformable annular membrane, in the form of a curved surface having a radius of curvature substantially continuous and symmetrical of revolution around a main axis of the container extending substantially perpendicular to the body between the step and the recess, and wherein the membrane has a circular outer edge at a junction with the step, and the membrane has circular inner edge at a junction with the recess.

2. Container according to claim 1, characterized in that the bottom comprises ribs extending at least in part radially and projecting on the membrane towards the interior of the container.

3. Container according to claim 2, characterized in that the ribs have a V-shaped cross section.

4. Container according to claim 2, characterized in that the bottom comprises a flat region extending from the step, and a counter step extending from the flat region, and in that the ribs are anchored, at an external end, in the counter step.

5. Container according to claim 2, characterized in that the ribs extend radially.

6. Container according to claim 2, characterized in that the ribs have two radial sections connected by an intermediate curved section.

7. Container according to claim 2, characterized in that the bottom comprises a central rib dividing the membrane into two parts, namely a central part surrounding the recess and a peripheral part surrounding the central part.

8. Container according to claim 7, characterized in that the central rib has a V-shaped profile in cross section.

9. Container according to claim 7, characterized in that the ribs extend in projection on the peripheral part of the membrane.

10. Container according to claim 9, characterized in that the ribs are anchored in the central rib, or are tangential thereto.

11. Container according to claim 1, characterized in that the membrane has, prior to any filling, a concavity turned towards the interior of the container.

12. Container according to claim 1, characterized in that the membrane has, prior to any filling, a concavity turned towards the exterior of the container.

13. Container according to claim 1, characterized in that the membrane has a radius of curvature between 50 mm and 150 mm.

14. Container according to claim 13, characterized in that the membrane has a radius of curvature of approximately 100 mm.

15. Container according to claim 1, characterized in that it is heat set.

16. Container according to claim 1, characterized in that the body is smooth.

17. A plastic container, comprising:

a rigid cylindrical body having a longitudinal axis; and a bottom provided at a lower end of the cylindrical body; the bottom including:

an annular base disposed in a plane substantially perpendicular to the longitudinal axis;

an annular step extending from the base towards an interior of the container;

a recess at a center of the bottom, axially aligned with the longitudinal axis, and projecting towards the interior of the container, wherein the recess includes a top portion; and a deformable annular membrane surrounding the recess so as to be disposed between the step and the recess, the annular membrane being in the form of a curved surface having a radius of curvature substantially continuous and symmetrical of revolution around a main axis of the container and axially aligned with the longitudinal axis, so that a virtual center of the membrane is located on the longitudinal axis and wherein the membrane has a circular outer edge at a junction with the step, and the membrane has a circular inner edge at a junction with the recess, wherein the recess includes a conically shaped side wall extending in height from the junction at the circular inner edge to the top portion of the recess, wherein the side wall includes a smooth-walled upper conical portion, a smooth-walled lower conical portion, and a recessed portion located at substantially mid-height of the side wall, which extends along the side wall in a circumferential direction, directly between the upper and lower conical portions.

* * * * *